US006645561B2

(12) United States Patent
Zitkus et al.

(10) Patent No.: US 6,645,561 B2
(45) Date of Patent: Nov. 11, 2003

(54) PROCESS FOR GLAZING A CHINAWARE ARTICLE AND AN ARTICLE PRODUCED THEREBY

(75) Inventors: Wayne J. Zitkus, Jamesville, NY (US); Joseph N. Benoit, Cazenovia, NY (US)

(73) Assignee: Syracuse China Company, Syracuse, NY (US)

( * ) Notice: Subject to any disclaimer, the term of this patent is extended or adjusted under 35 U.S.C. 154(b) by 0 days.

(21) Appl. No.: 10/082,817

(22) Filed: Feb. 25, 2002

(65) Prior Publication Data

US 2003/0161958 A1 Aug. 28, 2003

(51) Int. Cl.[7] ..... B05D 3/02; B05D 1/02; B05D 1/18

(52) U.S. Cl. ..... 427/376.2; 427/421; 427/427; 427/430.1; 427/443.2; 428/688

(58) Field of Search ..... 427/376.1, 376.2, 427/421, 427, 430.1, 443.2; 428/688

(56) References Cited

U.S. PATENT DOCUMENTS

| | | | | |
|---|---|---|---|---|
| 1,548,112 A | | 8/1925 | Barnhart | |
| 1,941,941 A | | 1/1934 | Irwin | |
| 1,971,784 A | | 8/1934 | Howell | |
| 2,273,475 A | | 2/1942 | Schreiber | |
| 2,574,878 A | * | 11/1951 | Liversage | 432/259 |
| 2,664,193 A | * | 12/1953 | Koch | 206/502 |
| 2,690,065 A | * | 9/1954 | Harman et al. | 206/503 |
| 3,137,910 A | | 6/1964 | Cummings | |
| 3,948,594 A | | 4/1976 | Irwin, Jr. | |
| 5,158,202 A | * | 10/1992 | Kosonen et al. | 220/574 |

FOREIGN PATENT DOCUMENTS

| | | |
|---|---|---|
| CA | 611586 | 12/1960 |

* cited by examiner

*Primary Examiner*—Michael Barr
(74) *Attorney, Agent, or Firm*—Emch, Schaffer, Schaub & Porcello Co., L.P.A.

(57) ABSTRACT

A process for glazing a chinaware article by forming a chinaware article having a bottom including a glazed foot and a dry foot. The glazed foot extends downwardly from the bottom to a point below the dry foot. A glaze is applied to the formed article so that the glaze is applied to the glazed foot and the dry foot is substantially free of the glaze. The article is supported on a supporting device so that the dry foot engages the device and the glazed foot is exposed. The article is heated to mature the article including the glaze. A glazed chinaware article is produced in the process.

28 Claims, 14 Drawing Sheets

PROCESS FOR GLAZING A CHINAWARE ARTICLE AND AN ARTICLE PRODUCED THEREBY

BACKGROUND OF THE INVENTION

The present invention relates generally to a process for glazing a chinaware article. More specifically, the invention is directed to a process for glazing a chinaware article in a single fire process in which the resulting chinaware article includes a glazed foot. The invention is further directed to the resulting chinaware article.

Chinaware articles, such as china plates, are made with either a glazed foot or a dry foot (i.e., foot free of glaze). The foot is the surface that the plate sits on in its normal position on a table.

In high-use environments, such as hotels and restaurants, it has been found that there are advantages to having a glazed foot on chinaware articles as compared to a dry foot. For example, a glazed foot allows for the article to be easily slipped over the surface of an adjacent article when stacked without scratching or damaging the surface. Chinaware having a dry foot can scratch adjacent articles upon contact. Further, a glazed foot is impervious and does not allow for metal marks or marks from other surfaces due to the glazed surface. The unglazed foot is also prone to attracting foreign material. This can result in health issues because a dry foot may become a bacteria breeding site.

When a chinaware article, such as a china plate, is being made with a glazed foot, it first must be bisque fired prior to a gloss firing. This is referred to in the industry as a "two fire" process wherein first bisque is made in the first firing and then the bisque is glazed and refired again to mature the glaze. When the bisque is glazed and ready for firing, the glazed plate must be supported by pins (usually 3 pins) that come into contact on the leaf or outside bottom edge of the plate. The pins can leave marks that must be removed.

Another method of manufacturing glazed chinaware is the "single fire" process. In this process, the chinaware article is formed into "greenware" having a foot. Glaze is applied to the article during which excess glaze is removed from the foot. If glaze is left on the foot, the article will stick to the support surface during the firing stage. After firing, the chinaware article has an unglazed rough "dry" foot. The dry foot can be polished to reduce roughness. However, the dry foot is still relatively rough as compared to a glazed foot.

It is usually less expensive and time consuming to manufacture a chinaware article in a single fire process as opposed to the two fire process. However, for the reasons stated above, a single fire process article having a dry foot is undesirable for some uses.

It has been found that there is a need for a process for glazing a chinaware article in a single fire process in which the final article includes a glazed foot. The present invention satisfies this need. The present invention provides a process that is efficient and economical.

SUMMARY OF THE INVENTION

The present invention is a process for glazing a chinaware article. The process includes forming a chinaware article having a bottom including a glazed foot and a dry foot in which the glazed foot extends downwardly from the bottom to a point below the dry foot. Glaze is applied to the article so that glaze is applied to the glazed foot and the dry foot is substantially free of the glaze. The article is supported on means for supporting a chinaware article so that the dry foot engages the means for supporting and the glazed foot is exposed. The article is heated or fired to mature the article including the glaze. The invention is further directed to a chinaware article glazed in accordance with the process of the invention.

The primary object of the present invention is to provide a process for glazing a chinaware article in a single fire process in which the article includes a glazed foot.

It is an important object of the present invention to provide a chinaware article glazed in accordance with the present process.

Other objects and advantages of the present invention will become apparent to those skilled in the art upon a review of the following detailed description of the preferred embodiments and the accompanying drawings.

Figure 18:
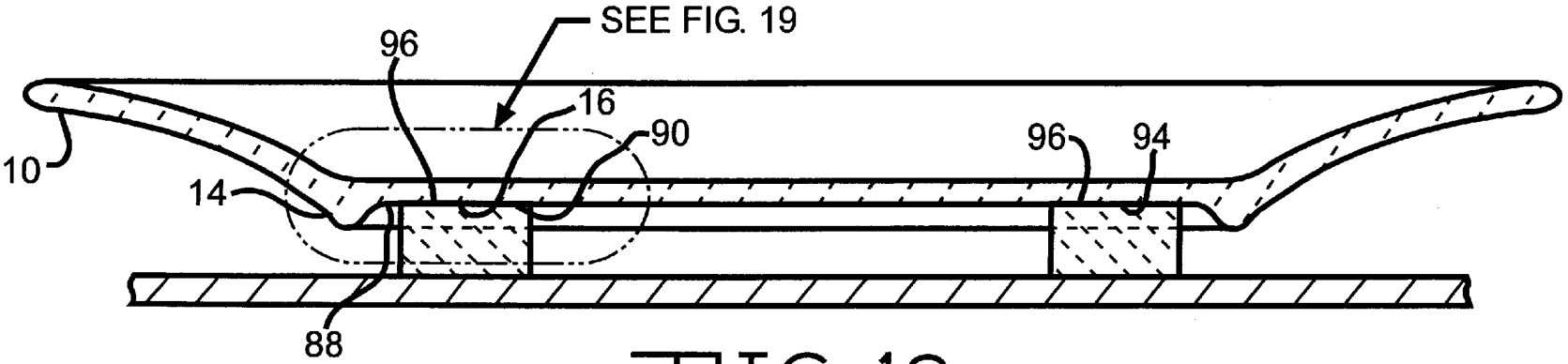
FIG. 18 is a cross-sectional view of the eighth embodiment chinaware article taken along line 18—18 of FIG. 17 and a cross-sectional view of a eighth embodiment refractory support pad.
Figure 19:
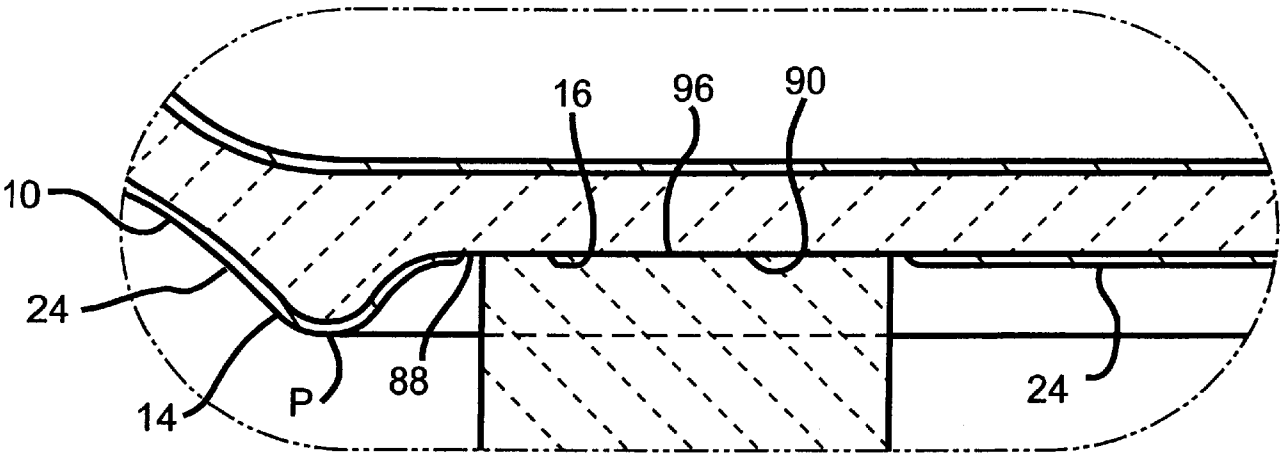
Figure 20:
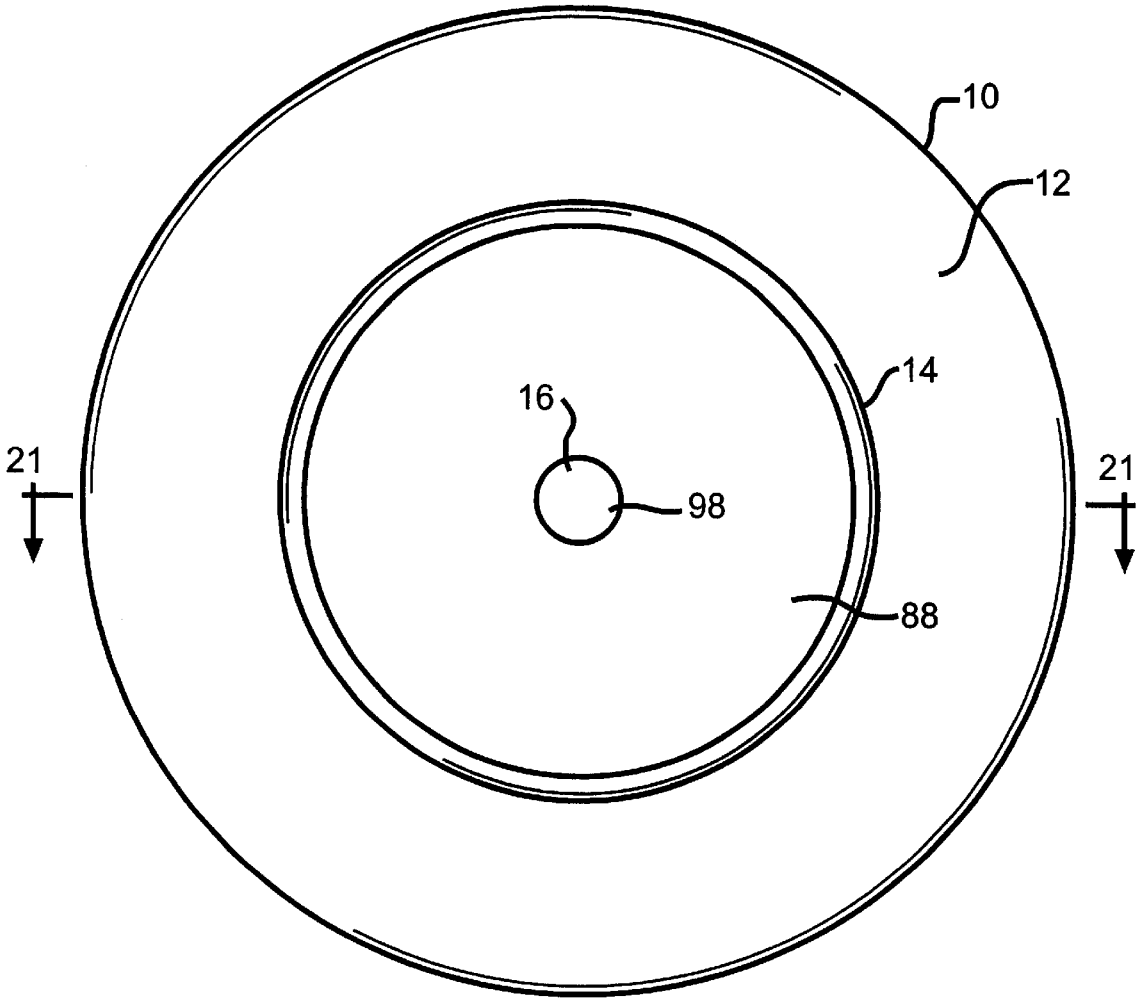
Figure 21:
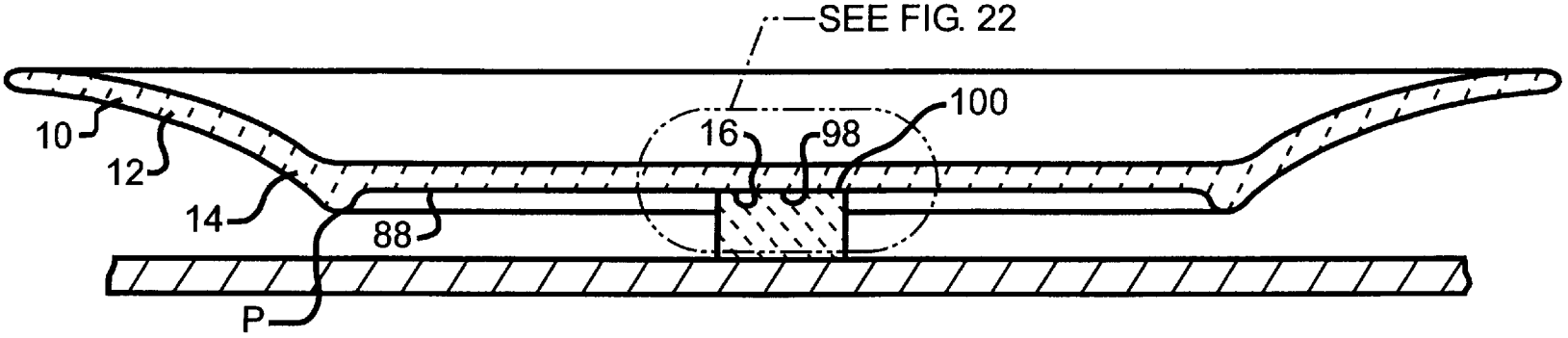
Figure 22:
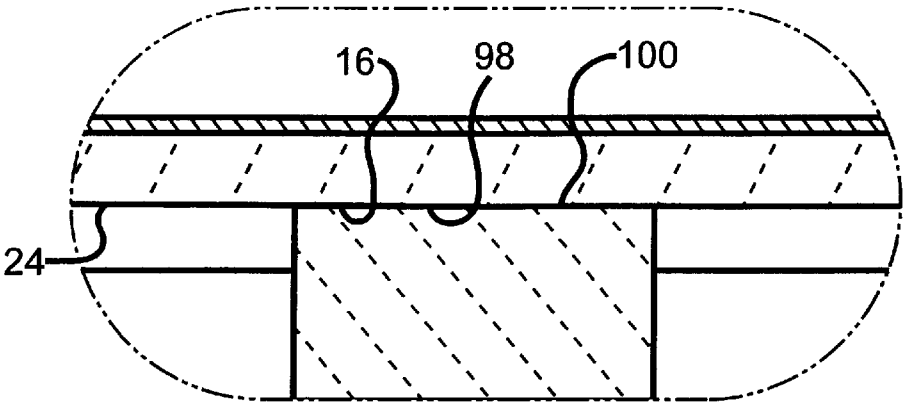

FIG. 19 is a detailed view as indicated in FIG. 18;

FIG. 20 is a plan view of the bottom of a ninth embodiment chinaware article according to the present invention;

FIG. 21 is a cross-sectional view of the ninth embodiment chinaware article taken along line 21—21 of FIG. 20 and a cross-sectional view of a ninth embodiment refractory support pad;

FIG. 22 is a detailed view as indicated in FIG. 21; and

Figure 23:
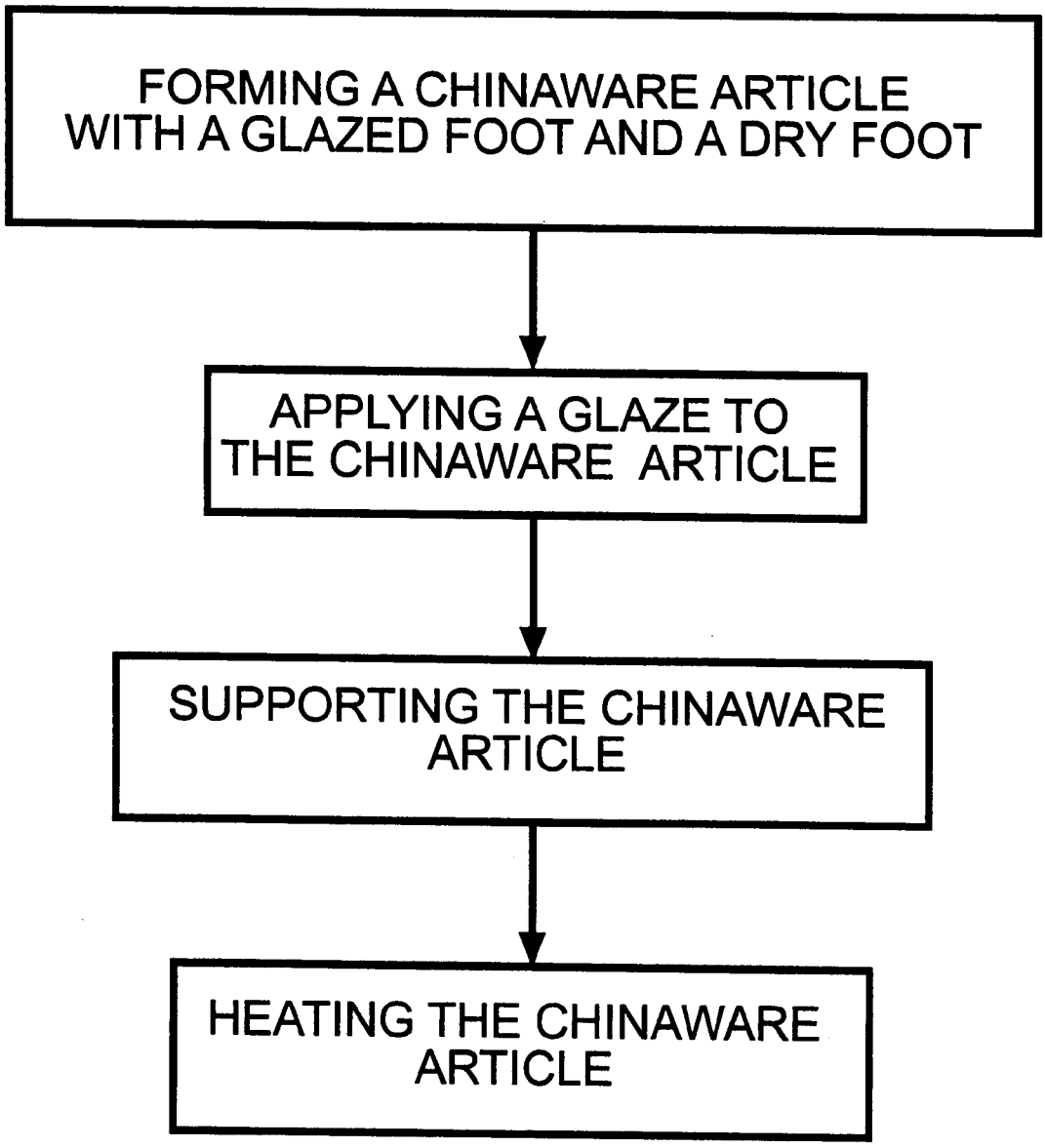

FIG. 23 is a flow diagram showing the process steps according to the present invention.

DETAILED DESCRIPTION OF THE PREFERRED EMBODIMENTS

The preferred embodiments and best mode of the present invention will now be described in detail with reference being made to the drawings. The present invention is a process for glazing a chinaware article. The invention is also directed to a chinaware article glazed in accordance with the process. The present invention includes a number of embodiments. However, each of the embodiments includes the process steps of:

(a) forming a chinaware article having a bottom including a glazed foot and a dry foot, the glazed foot extending downwardly from the bottom to a point below the dry foot;

(b) applying a glaze on the article wherein the glaze is applied to the glazed foot and the dry foot being substantially free of the glaze;

(c) supporting the article on a device or means for supporting a chinaware article so that the dry foot engages the device for supporting and the glazed foot is exposed; and (d) heating the article to mature the article including the glaze.

As described below, the chinaware article is formed into a variety of shapes. The common feature of each chinaware article is that the bottom of the article includes a glazed foot and a dry foot wherein the glazed foot extends downwardly from the bottom to a point below the dry foot. The term "glazed foot" means that the foot is glazed during the process of the present invention. The term "dry foot" means that the foot is free or substantially free of glaze.

After formation, glaze is applied to the chinaware article. This can be done by immersion of the article in a glaze bath or by spraying the article with glaze. After the glaze is applied, excess glaze is removed from the dry foot so that it is free or substantially free of the glaze.

The chinaware article is supported on a device or means for supporting the article so that the dry foot engages the supporting device and the glazed foot is exposed. The supporting device can be a refractory support pad or ring that is adapted to support the dry foot of the chinaware article.

The chinaware article is heated or fired to mature the entire article including the glaze. In a preferred embodiment, this step is completed in a single fire process in which the chinaware article is heated or fired only once during the manufacturing process.

Figure 2:
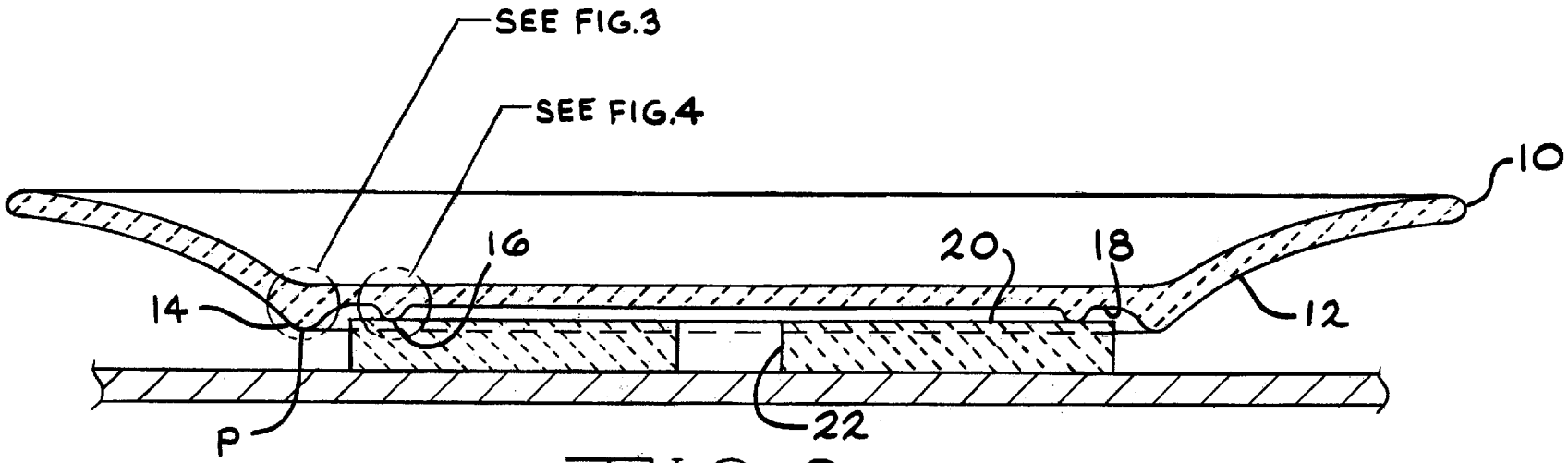
FIG. 2 is a side-elevational view of the first embodiment chinaware article shown in cross section along line 2—2 of FIG. 1 positioned on a first embodiment refractory support pad that is also shown in cross section.
Figure 3:
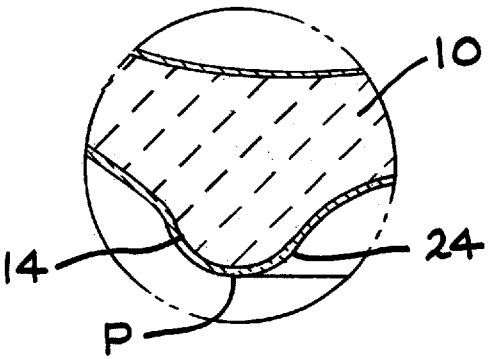
FIG. 3 is a detailed view of a glazed foot as indicated in FIG. 2.

The present process produces a chinaware article that has a bottom including a glazed foot and a dry foot in which the glazed foot extends downwardly from the bottom to a point below the dry foot. This eliminates the problems associated with previous single fire processes and articles. The present invention also provides a process and a resulting chinaware article that is economical and efficient as compared to previous two fire processes and articles Referring to FIGS. 1–4, a first embodiment chinaware article 10 includes a bottom 12 having a glazed foot 14 and a dry foot 16. As shown in FIGS. 2 and 3, the glazed foot 14 extends downwardly from the bottom 12 to a point P below the dry foot 16.

Figure 1:
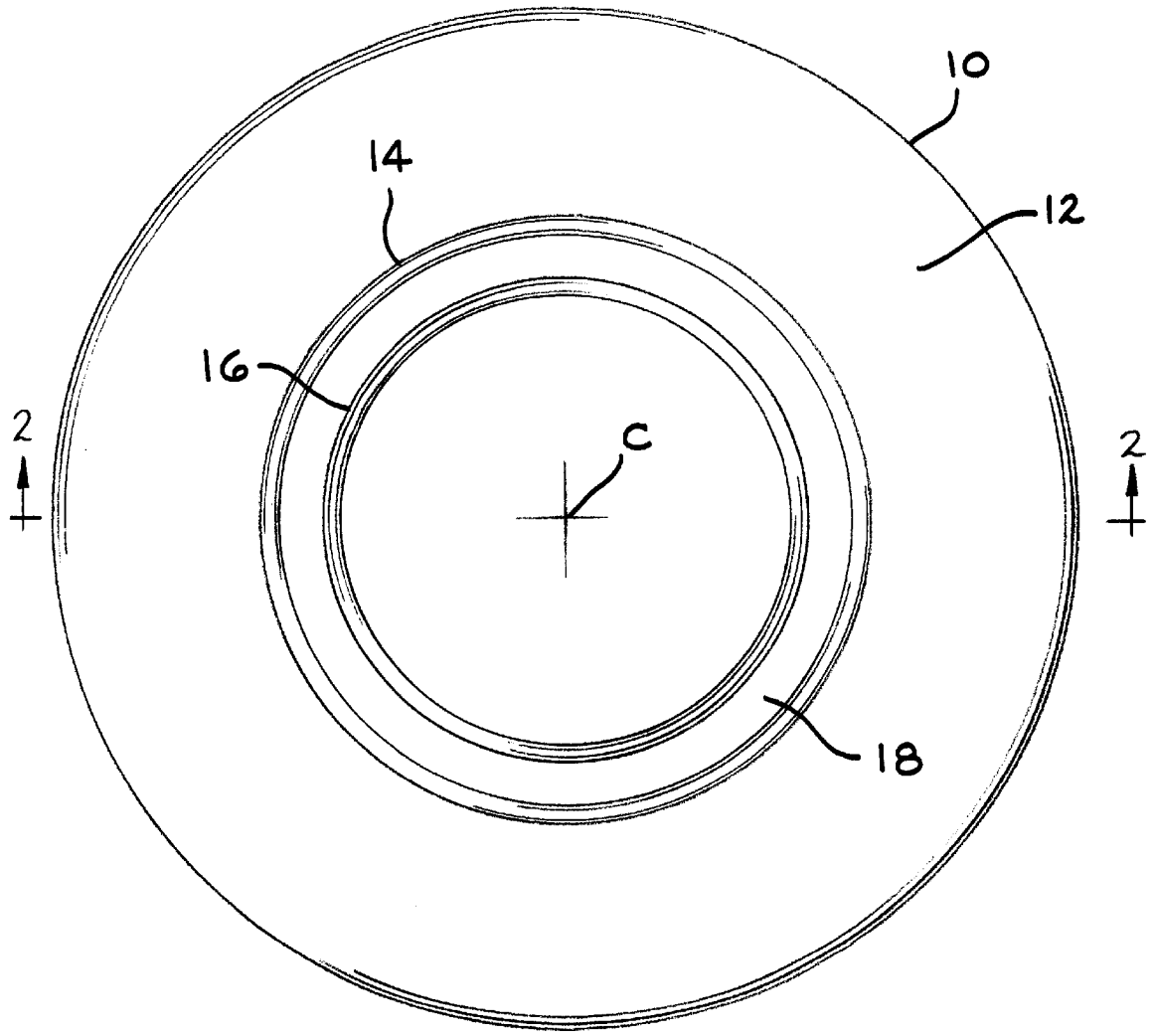
FIG. 1 is a plan view of the bottom of a first embodiment chinaware article produced by the process of the present invention.

As shown in FIG. 1, the chinaware article 10 is formed with the glazed foot 14 and the dry foot 16 being continuous concentric rings with a center C. The dry foot 16 is positioned in a space 18 defined by the glazed foot 14.

Figure 4:
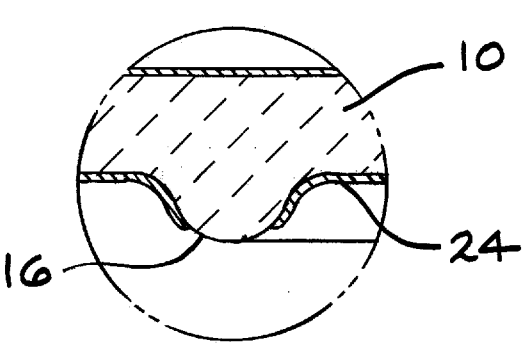
FIG. 4 is a detailed view of a dry foot as indicated in FIG. 2.

Referring to FIGS. 2–4, the chinaware article 10 is supported by a first embodiment refractory pad 20 having an opening 22 that is sized and adapted to engage the dry foot 16 while allowing the glazed foot 14 to be exposed. The pad 20 has a shape corresponding to the shape of the dry foot 16. In a preferred embodiment, the pad 20 has a circular shape corresponding to the circular shape of the dry foot 16 shown in FIG. 1. However, it should be understood that the pad 20 can be a variety of shapes depending on the shape of the dry foot.

The pad 20 supports the chinaware article 10 in a heating device such as a kiln during the heating or firing step of the process. After heating, the chinaware article 10 is removed from the pad 20.

As shown in FIGS. 3 and 4, the finished chinaware article 10 includes a glazed foot 14 and a dry foot 16 as described above. In the drawings, the glaze is indicated by the reference number 24.

Figure 5:
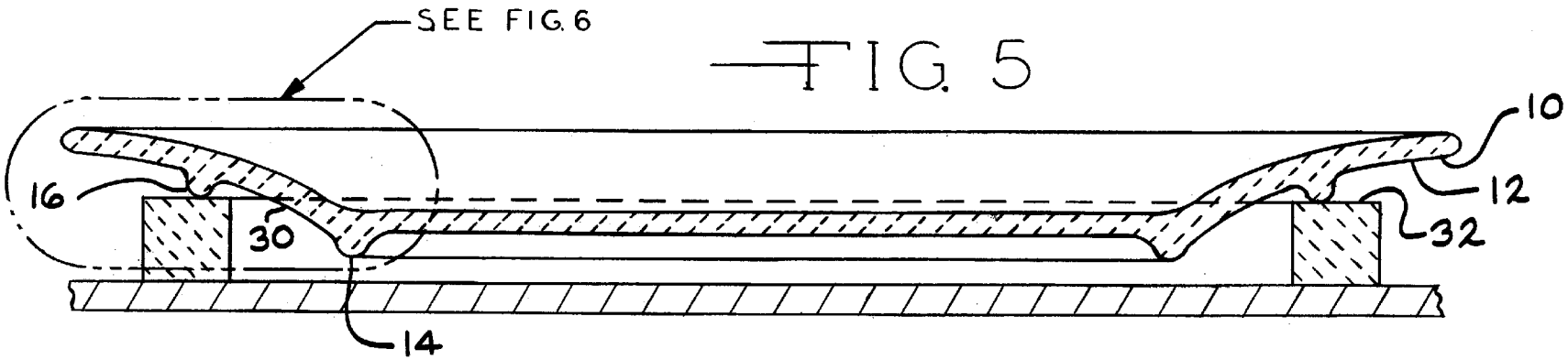
FIG. 5 is a cross-sectional view of a second embodiment chinaware article positioned on a second embodiment refractory support pad.
Figure 6:
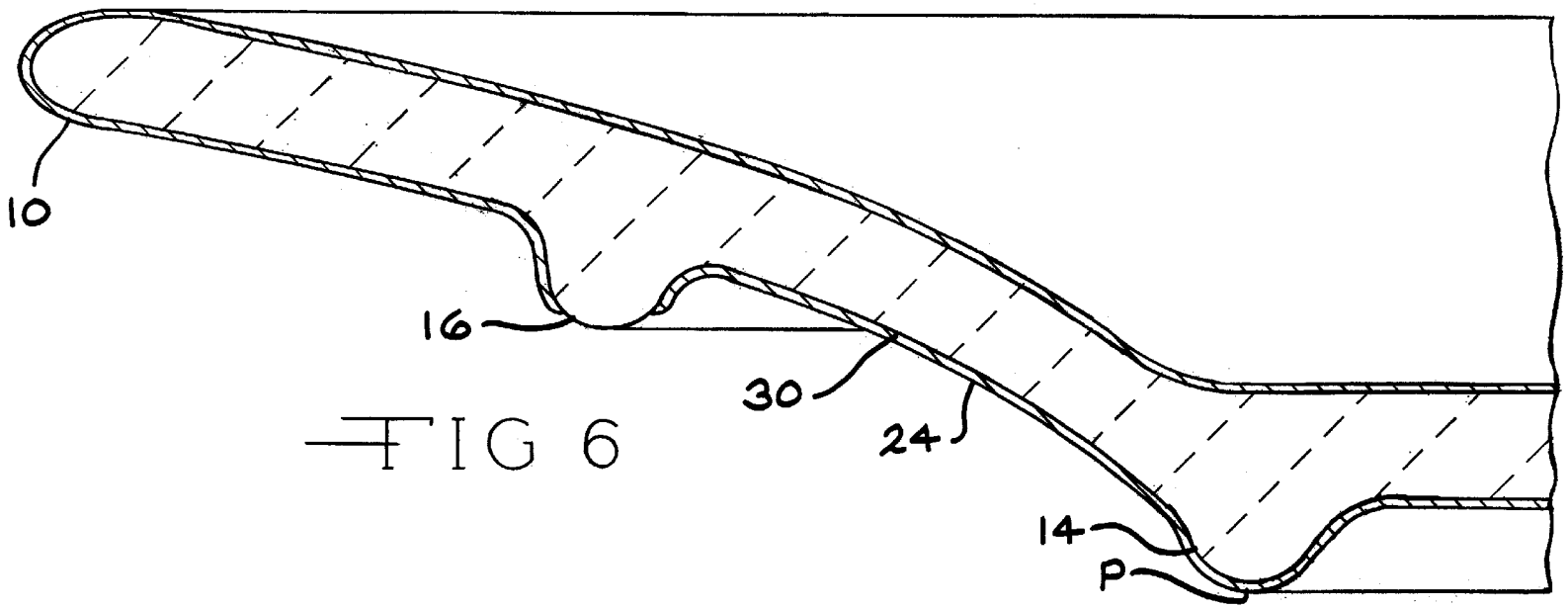
FIG. 6 is a detailed view as indicated in FIG. 5.

Referring to FIGS. 5 and 6, a second embodiment chinaware article 10 has a bottom 12 including a glazed foot 14 and a dry foot 16. In this embodiment, the glazed foot 14 and the dry foot 16 are continuous concentric rings in which the glazed foot 14 is positioned in a space 30 defined by the dry foot 16. It should be understood that the glazed foot 14 and the dry foot 16 can be formed in a variety of shapes depending on the shape of the dry foot.

As shown in FIG. 5, the dry foot 16 engages or rests on a second embodiment refractory pad 32. The pad 32 is sized and adapted to correspond to the shape of the dry foot 16. When the chinaware article 10 is positioned on the pad 32, the glazed foot 14 is exposed.

Figure 7:
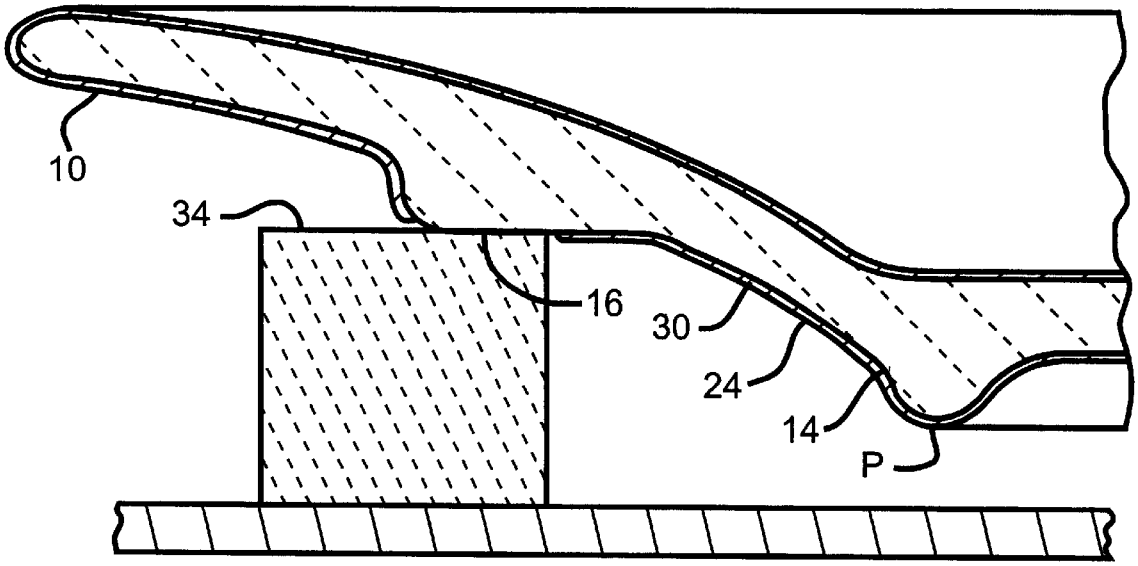
FIG. 7 is a cross-sectional view of a third embodiment chinaware article positioned on a third embodiment refractory support pad.

Referring to FIG. 7, a third embodiment chinaware article 10 is shown. This embodiment is similar to the second embodiment. In the third embodiment, the dry foot 16 is elongated. The third embodiment refractory pad 34 is sized and adapted to correspond to the shape of the dry foot 16.

Figure 8:
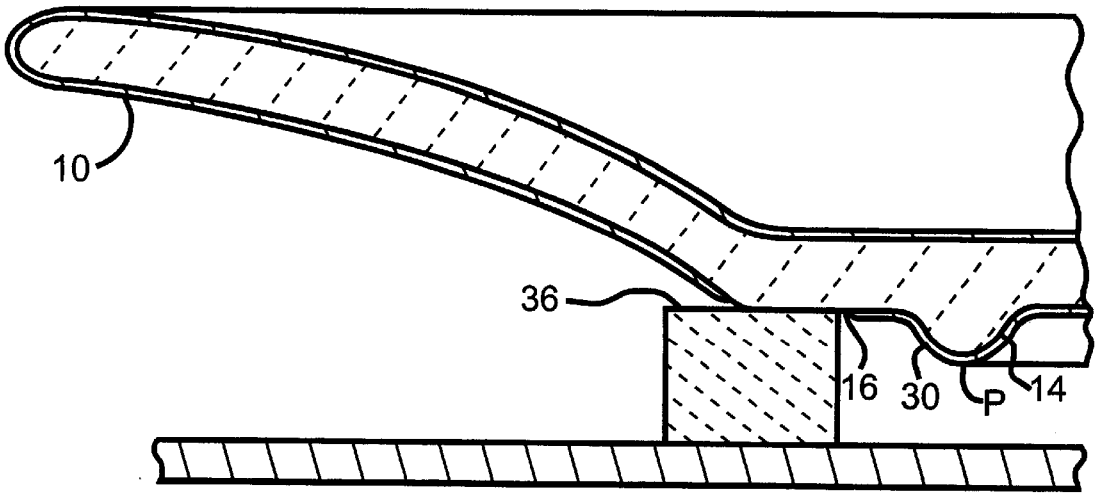
FIG. 8 is a cross-sectional view of a fourth embodiment chinaware article and a fourth embodiment refractory support pad.

A fourth embodiment chinaware article 10 is shown in FIG. 8. This embodiment also includes an elongated dry foot 16. The fourth embodiment refractory pad 36 is sized and adapted to correspond to the shape of the fourth embodiment dry foot 16.

Figure 9:
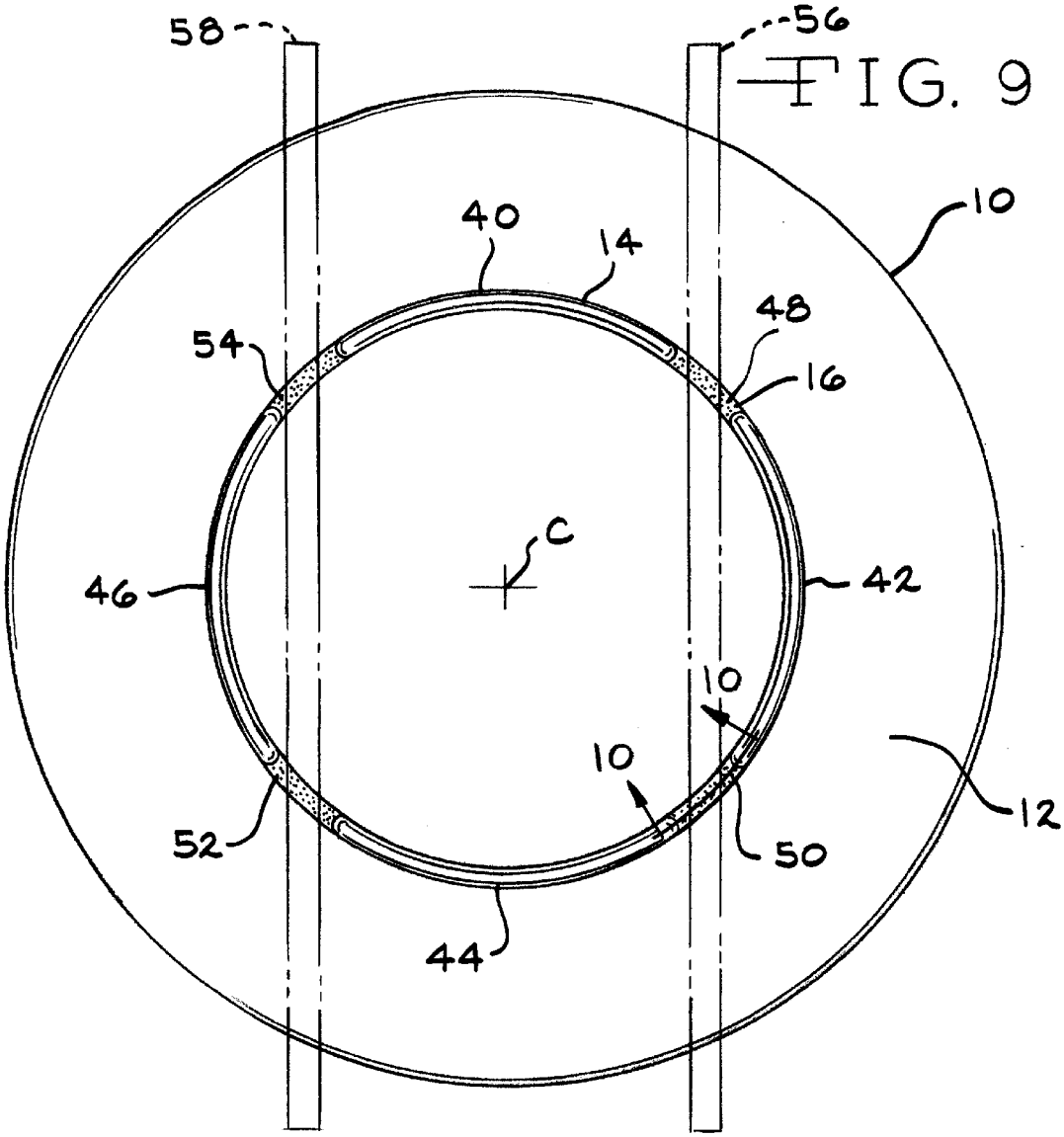
FIG. 9 is a plan view of the bottom of a fifth embodiment chinaware article and the corresponding refractory support rails therefor.
Figure 10:
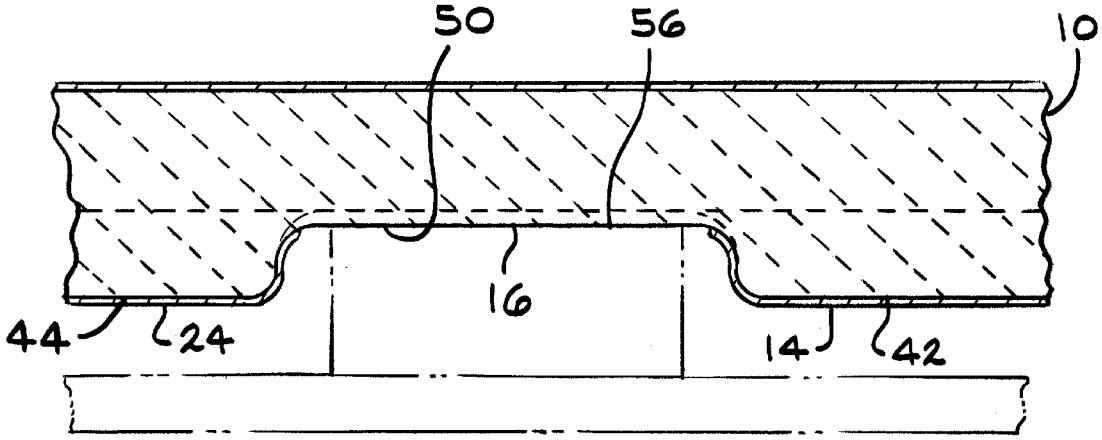
FIG. 10 is a cross-sectional view taken along line 10—10 of FIG. 9.

Referring to FIGS. 9 and 10, a fifth embodiment chinaware article 10 includes a glazed foot 14 consisting of four sections 40, 42, 44 and 46. The dry foot 16 consists of four openings or notches 48, 50, 52 and 54 that are contiguous with the glazed foot 14. In the fifth embodiment, the glazed foot 14 and the dry foot 16 extend along a common radius from the center C. However, it should be understood that the shape and size of the glazed foot 14 and the dry foot 16 can vary depending on the type of chinaware article 10.

Still referring to FIGS. 9 and 10, the fifth embodiment chinaware article 10 is supported by two spaced parallel refractory rails 56 and 58 in which notches 48 and 50 are supported on rail 56 and notches 52 and 54 are supported on rail 58.

Figure 11:
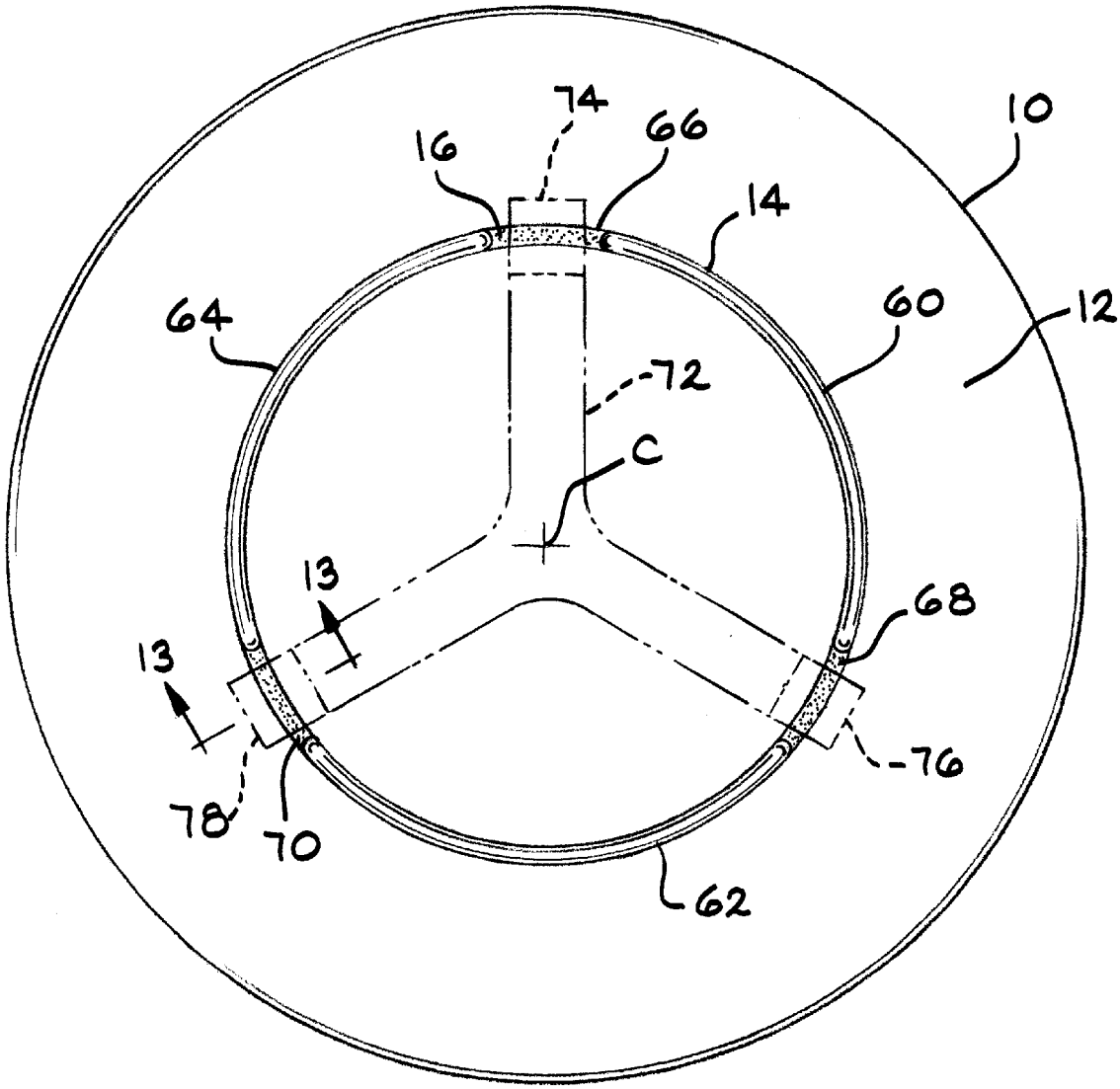
FIG. 11 is a plan view of the bottom of a sixth embodiment chinaware article and the corresponding refractory support rails therefor.
Figure 12:
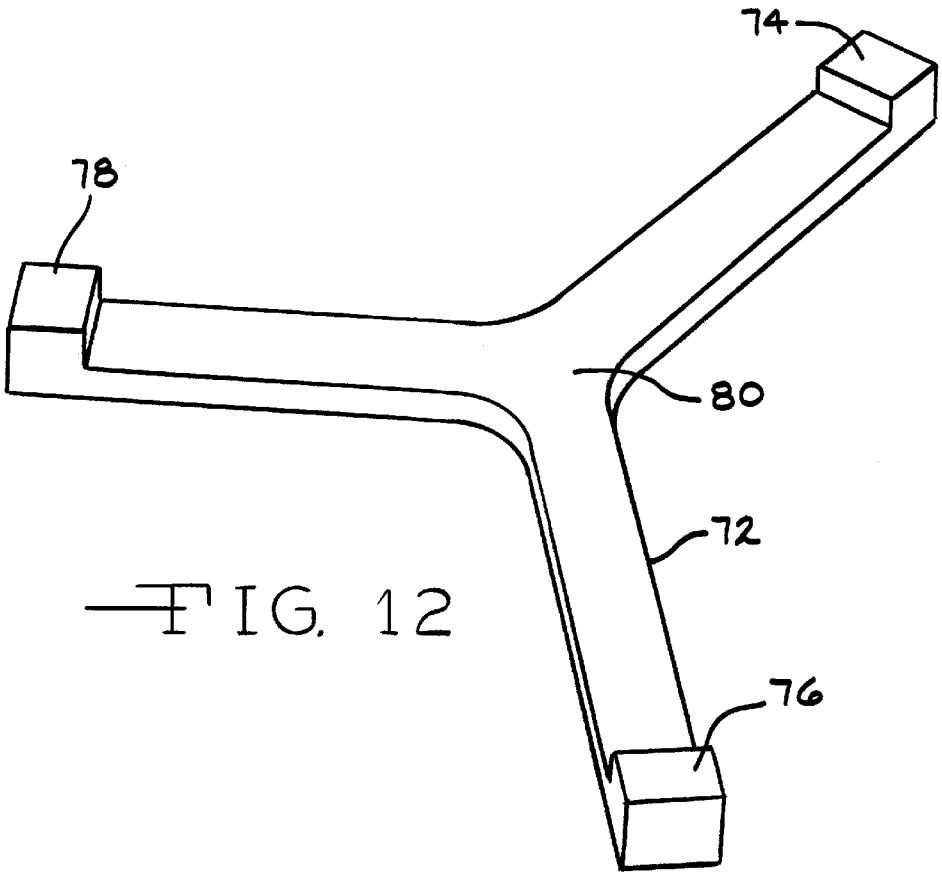
FIG. 12 is a perspective view of the refractory support rails shown in FIG. 11.
Figure 13:
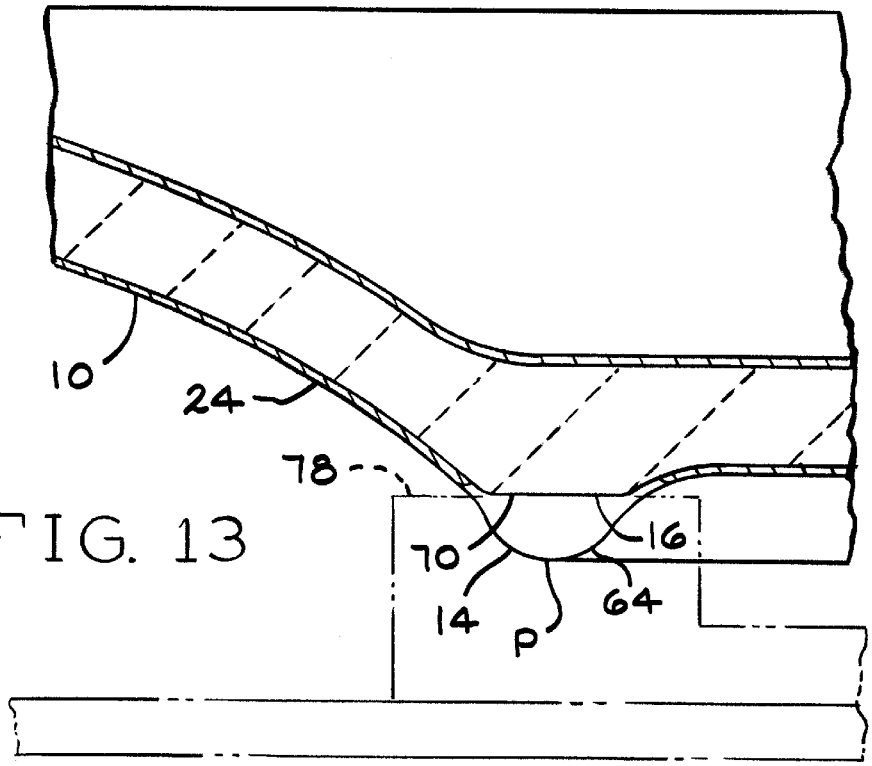
FIG. 13 is cross-sectional view taken along line 13—13 of FIG. 11.

Referring to FIGS. 11–13, a sixth embodiment chinaware article 10 is shown. In this embodiment, the chinaware article 10 includes a glazed foot 14 consisting of three sections 60, 62 and 64. The dry foot 16 consists of three notches 66, 68 and 70 that are contiguous with the glazed foot 14. In this embodiment, the glazed foot 14 and the dry foot 16 extend along a common radius from the center C. However, it should be understood that the shape and size of the glazed foot 14 and the dry foot 16 can vary depending on the type of chinaware article 10.

The sixth embodiment chinaware article 10 is supported by a sixth embodiment refractory pad 72 as shown in FIG. 12. The pad 72 includes three spaced rails 74, 76 and 78 extending outwardly from a hub 80. The rails 74, 76 and 78 are sized and adapted to engage notches 66, 68 and 70, respectively, as shown in FIGS. 11 and 13.

Figure 14:
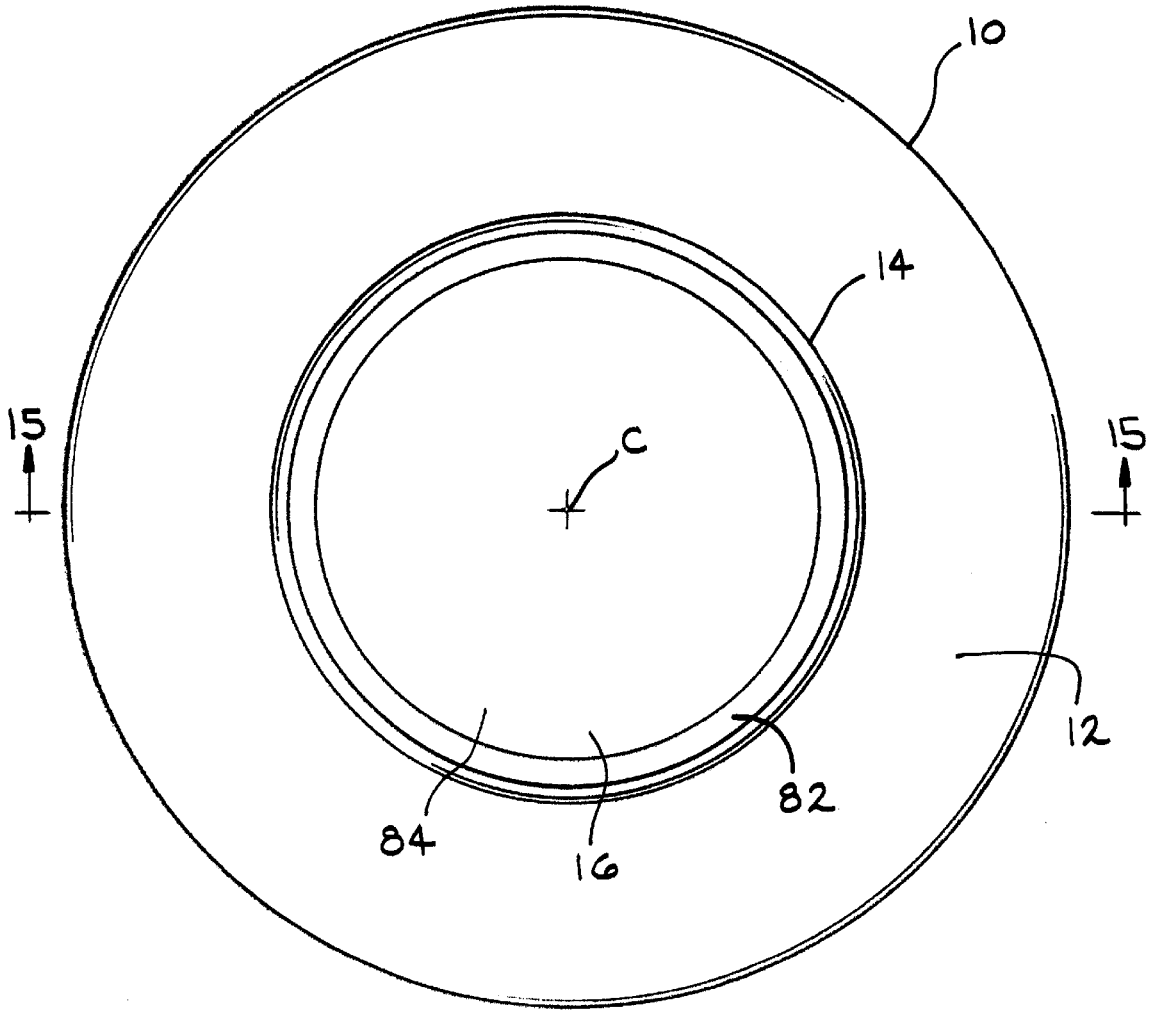
FIG. 14 is a plan view of the bottom of a seventh embodiment chinaware article according to the present invention.
Figure 15:
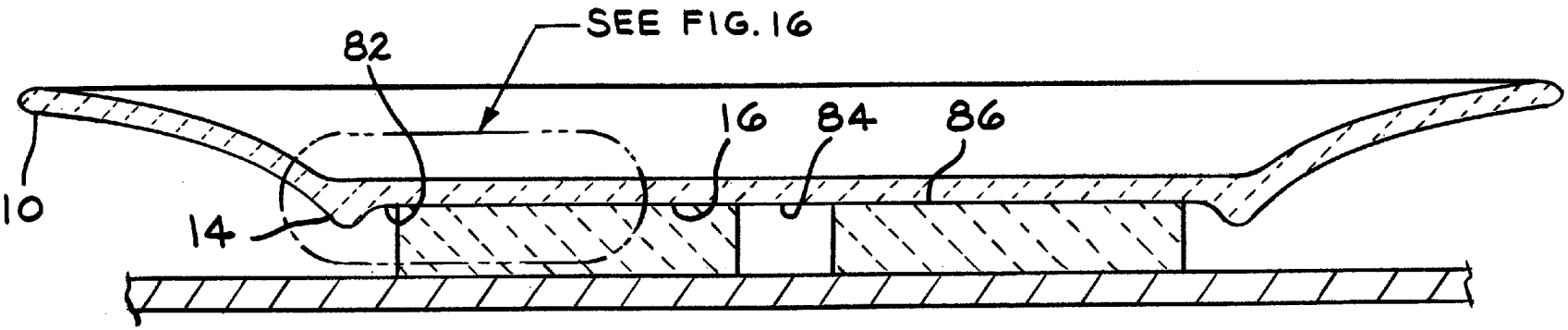
FIG. 15 is a cross-sectional view of the seventh embodiment chinaware article taken along line 15—15 of FIG. 14 and a cross-sectional view of a seventh embodiment refractory support pad.
Figure 16:
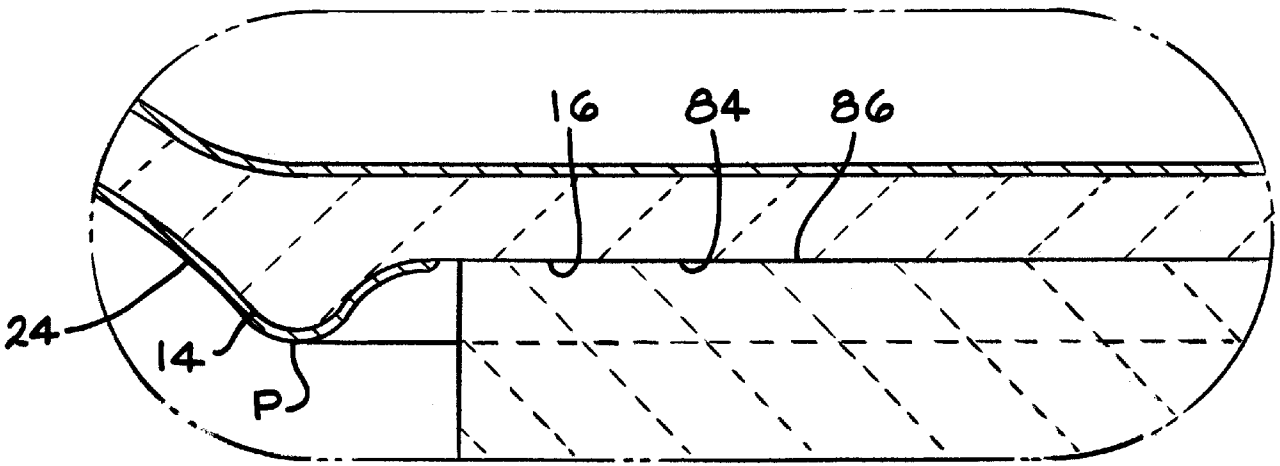
FIG. 16 is a detailed view as indicated in FIG. 15.

Referring to FIGS. 14–16, a seventh embodiment chinaware article 10 has a bottom 12 including a glazed foot 14 defining a space 82. In this embodiment, the dry foot 16 consists of a flat surface 84 that is positioned within the space 82. In a preferred embodiment, the flat surface 84 has a shape corresponding to the shape of the glazed foot 14, such as the circular shape shown in FIG. 14. However, it should be understood that the flat surface 84 can be a variety of shapes and sizes.

A seventh embodiment refractory pad 86 is shown in FIGS. 15 and 16. The pad 86 is sized and adapted to engage the dry foot 16 consisting of the flat surface 84 of the chinaware article 10.

Figure 17:
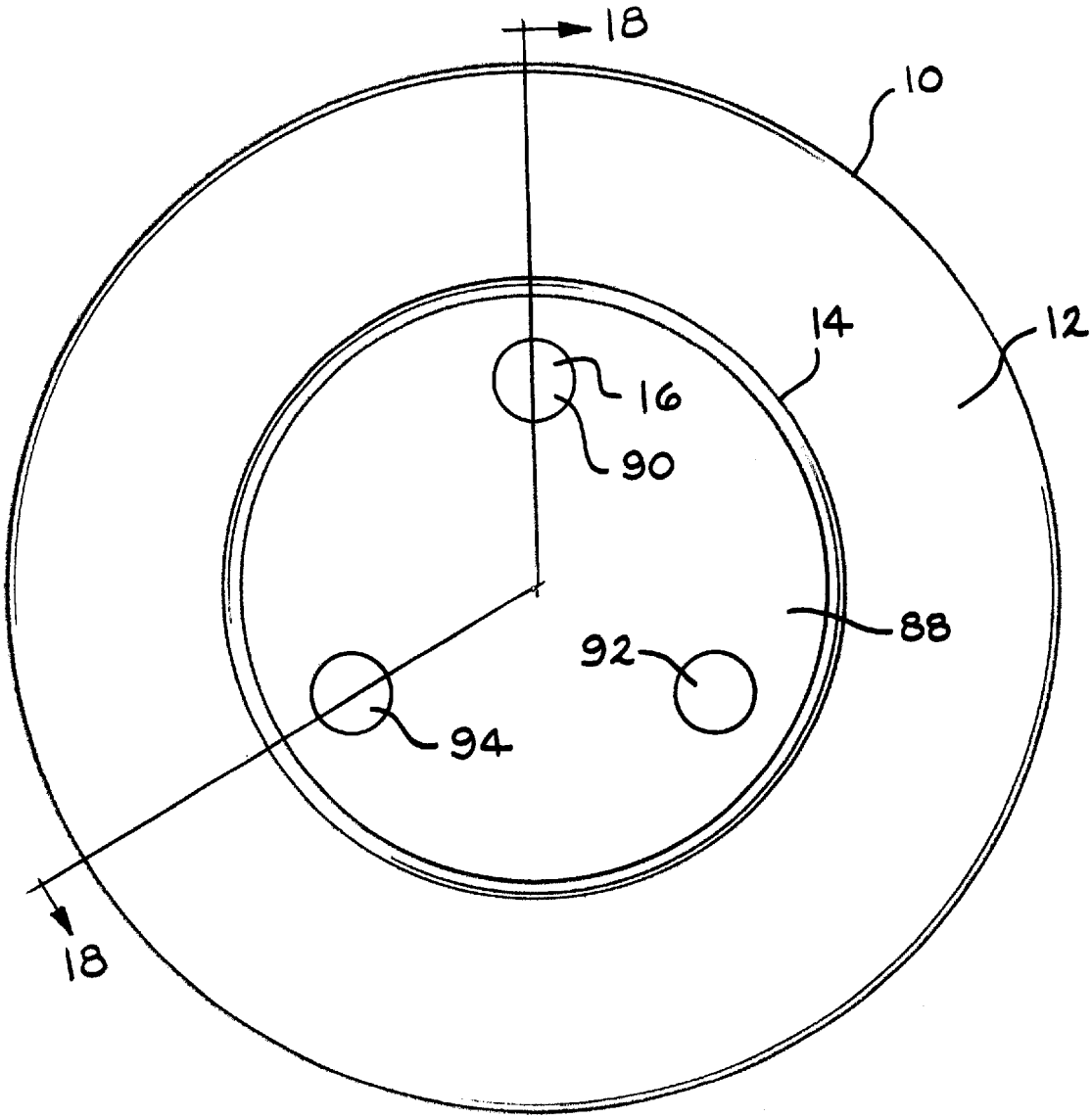
FIG. 17 is a plan view of the bottom of an eighth embodiment chinaware article according to the present invention.

Referring to FIGS. 17–19, an eighth embodiment chinaware article 10 has a bottom 12 including a glazed foot 14 defining a space 88. The dry foot 16 consists of three spaced flat surfaces 90, 92 and 94 positioned in the space 88. In a preferred embodiment, the flat surfaces 90–94 are circular in shape. However, it should be understood that the flat surfaces 90–94 can be a variety of shapes and sizes. The dry foot 16 consisting of the flat surfaces 90–94 is supported by an eighth embodiment refractory pad 96 that engages each of the flat surfaces 90–94.

A ninth embodiment chinaware article 10 is shown in FIGS. 20–22. The ninth embodiment chinaware article 10 is similar to the eighth embodiment article 10. The ninth embodiment article 10 includes a single flat surface 98 and a corresponding ninth embodiment refractory pad 100.

FIG. 23 is a flow diagram showing the process steps according to the present invention. The other process steps described above are also part of the present invention.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A process for glazing a chinaware article comprising:

(a) forming a chinaware article having a bottom including a glazed foot and a dry foot, said glazed foot extending downwardly from said bottom to a point below said dry foot;

(b) applying a glaze on said article wherein said glaze is applied to said glazed foot and said dry foot being substantially free of said glaze;

(c) supporting said article on means for supporting a chinaware article wherein said dry foot engages said means for supporting and said glazed foot being exposed; and (d) heating said article to mature said article including said glaze.

2. A chinaware article glazed in accordance with the process of claim 1.

3. The process of claim 1 wherein said chinaware is formed with said dry foot being positioned in a space defined by said glazed foot.

4. A chinaware article glazed in accordance with the process of claim 3.

5. The process of claim 1 wherein said chinaware is formed with said glazed foot being positioned in a space defined by said dry foot.

6. A chinaware article glazed in accordance with the process of claim 5.

7. The process of claim 1 wherein said chinaware article is formed with said glazed foot and said dry foot being concentric rings wherein said dry foot being positioned in a space defined by said glazed foot.

8. A chinaware article glazed in accordance with the process of claim 7.

9. The process of claim 1 wherein said chinaware is formed with said glazed foot and said dry foot being concentric rings wherein said glazed foot being positioned in a space defined by said dry foot.

10. A chinaware article glazed in accordance with the process of claim 9.

11. The process of claim 1 wherein said chinaware is formed with said dry foot being at least one notch positioned contiguous with said glazed foot.

12. A chinaware article glazed in accordance with the process of claim 11.

13. The process of claim 1 wherein said chinaware is formed with said dry foot being three notches positioned contiguous with said glazed foot.

14. A chinaware article glazed in accordance with the process of claim 13.

15. The process of claim 1 wherein said chinaware is formed with said dry foot being four notches positioned contiguous with said glazed foot.

16. A chinaware article glazed in accordance with the process of claim 15.

17. The process of claim 1 wherein said chinaware is formed with said dry foot being at least one flat surface positioned within a space defined by said glazed foot.

18. A chinaware article glazed in accordance with the process of claim 17.

19. The process of claim 1 wherein said chinaware is formed with said dry foot being at least three flat surfaces positioned within a space defined by said glazed foot.

20. A chinaware article glazed in accordance with the process of claim 19.

21. The process of claim 1 wherein said glaze is applied by immersion of said article in said glaze.

22. The process of claim 1 wherein said glaze is applied by spraying said article with said glaze.

23. The process of claim 1 wherein said means for supporting a chinaware article comprises a base adapted to engage said dry foot.

24. The process of claim 1 wherein said means for supporting a chinaware article comprises a refractory pad adapted to engage said dry foot.

25. The process of claim 1 wherein said means for supporting a chinaware article comprises at least two spaced generally parallel rails.

26. The process of claim 1 wherein said means for supporting a chinaware article comprises at least three spaced rails extending outwardly from a hub.

27. The process of claim 1 wherein said chinaware article is heated no more than one time.

28. The process of claim 1 wherein said heating is a single firing of said chinaware article.

* * * * *